US011781795B2

(12) United States Patent
Yamaguchi

(10) Patent No.: US 11,781,795 B2
(45) Date of Patent: Oct. 10, 2023

(54) AIR-CONDITIONING APPARATUS

(71) Applicant: Mitsubishi Electric Corporation, Tokyo (JP)

(72) Inventor: Koji Yamaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 268 days.

(21) Appl. No.: 17/426,302

(22) PCT Filed: Apr. 2, 2019

(86) PCT No.: PCT/JP2019/014638
§ 371 (c)(1),
(2) Date: Jul. 28, 2021

(87) PCT Pub. No.: WO2020/202465
PCT Pub. Date: Oct. 8, 2020

(65) Prior Publication Data

US 2022/0120485 A1 Apr. 21, 2022

(51) Int. Cl.
*F24F 11/36* (2018.01)
*F25B 49/02* (2006.01)

(52) U.S. Cl.
CPC ..... *F25B 49/022* (2013.01); *F24F 11/36* (2018.01); *F25B 2500/222* (2013.01); *F25B 2600/0251* (2013.01); *F25B 2600/2515* (2013.01)

(58) Field of Classification Search
CPC ..... F25B 49/022; F25B 2500/222; F25B 2600/0251; F25B 2600/2515; F24F 11/36
See application file for complete search history.

(56) References Cited

U.S. PATENT DOCUMENTS 6,866,092 B1 * 3/2005 Molivadas ..... F01L 3/12 165/47
2003/0213254 A1 * 11/2003 Koo ..... F25B 13/00 62/174

(Continued)

FOREIGN PATENT DOCUMENTS

JP 2002-372317 A 12/2002
JP 2017-053509 A 3/2017

(Continued)

OTHER PUBLICATIONS

Examination Report dated May 26, 2022 issued in corresponding AU Patent Application No. 2019438605.

(Continued)

*Primary Examiner* — Jonathan Bradford
(74) *Attorney, Agent, or Firm* — POSZ LAW GROUP, PLC

(57) ABSTRACT

An air-conditioning apparatus includes a first indoor unit and an outdoor unit in a single refrigeration cycle and connected via a first refrigerant pipe. The first indoor unit is provided with a first refrigerant leakage sensor configured to detect leakage of refrigerant and a concentration of leaked refrigerant, and the outdoor unit includes a compressor, a first flow control valve configured to adjust a flow rate of the refrigerant flowing through the first refrigerant pipe, and a control unit configured to stop the compressor and fully close the first flow control valve when leakage of the refrigerant flowing through the first refrigerant pipe is detected by the first refrigerant leakage sensor, and configured to change an opening speed of the first flow control valve to a speed less than an opening speed of the first flow control valve adopted before the leakage of the refrigerant is detected.

8 Claims, 7 Drawing Sheets

(56) References Cited

U.S. PATENT DOCUMENTS

| | | | |
|---|---|---|---|
| 2011/0192189 | A1 | 8/2011 | Morimoto et al. |
| 2019/0203997 | A1 | 7/2019 | Sakae et al. |
| 2019/0226705 | A1 | 7/2019 | Sakae et al. |
| 2020/0271344 | A1 | 8/2020 | Ikeda et al. |

FOREIGN PATENT DOCUMENTS

| | | | |
|---|---|---|---|
| JP | 2018-009769 | A | 1/2018 |
| JP | 6377299 | B1 | 8/2018 |
| WO | 2010/050007 | A1 | 5/2010 |
| WO | 2018/043721 | A1 | 3/2018 |

OTHER PUBLICATIONS

Examination Report dated Sep. 25, 2022 issued in corresponding AU Patent Application No. 2019438605.

International Search Report dated Jun. 18, 2019, issued in corresponding International Application No. PCT/JP2019/014638 (and English Machine Translation).

* cited by examiner

AIR-CONDITIONING APPARATUS

CROSS REFERENCE TO RELATED APPLICATION

This application is a U.S. National Stage Application of International Application No. PCT/JP2019/014638, filed on Apr. 2, 2019, the contents of which are incorporated herein by reference.

TECHNICAL FIELD

The present disclosure relates to an air-conditioning apparatus that uses combustible refrigerant.

BACKGROUND ART

In recent years, an air-conditioning apparatus is proposed that uses combustible refrigerant having a small global warming potential, such as R32, as refrigerant used in place of R410A. The specific gravity of combustible refrigerant is greater than the specific gravity of air and hence, refrigerant is likely to stagnate.

In some air-conditioning apparatus, a refrigerant leakage detection sensor may be provided to an indoor unit. When the refrigerant leakage detection sensor detects refrigerant leakage, a control unit closes the valve of a refrigerant pipe of a refrigeration cycle to prevent refrigerant from being supplied to the indoor unit where leakage is occurring (see Patent Literature 1, for example).

CITATION LIST

Patent Literature

Patent Literature 1: Japanese Unexamined Patent Application Publication No. 2018-9769

SUMMARY OF INVENTION

Technical Problem

In some technique, when a refrigerant leakage detection sensor detects leakage of refrigerant, a control unit closes the valve of a refrigerant pipe of a refrigeration cycle. With such an operation, the air-conditioning apparatus is configured to retain refrigerant in the outdoor unit. As a result, it is possible to eliminate leakage of refrigerant from the indoor unit.

Usually, refrigerant that cycles through the refrigeration cycle is filled in the outdoor unit. Depending on the number of indoor units connected and the length of the refrigerant pipe, additional refrigerant may be required and, in such a case, the amount of refrigerant sealed may exceed the amount of refrigerant filled in the outdoor unit.

As a result, the amount of refrigerant in the air-conditioning apparatus may exceed the amount of refrigerant shipped with the air-conditioning apparatus. When the amount of refrigerant in the air-conditioning apparatus is increased as described above, there is a problem in that all the refrigerant cannot be retained in the outdoor unit. Further, when the valve of the refrigerant pipe is rapidly opened, the concentration of leaked refrigerant in the indoor space is drastically increased.

The present disclosure has been made in view of the above-mentioned circumstances, and it is an object of the present disclosure to provide an air-conditioning apparatus configured to reduce the concentration of leaked refrigerant in the indoor space at a low level even in the case where refrigerant cannot be retained in the outdoor unit.

Solution to Problem

According to a first aspect, an air-conditioning apparatus of an embodiment includes a first indoor unit included in a single refrigeration cycle and an outdoor unit connected to the first indoor unit via a first refrigerant pipe, and the outdoor unit is included in the single refrigeration cycle. The first indoor unit is provided with a first refrigerant leakage sensor configured to detect leakage of refrigerant flowing through the first refrigerant pipe and a concentration of leaked refrigerant, and the outdoor unit includes a compressor configured to compress the refrigerant flowing through the first refrigerant pipe, a first flow control valve configured to adjust a flow rate of the refrigerant flowing through the first refrigerant pipe, and a control unit configured to stop the compressor and fully close the first flow control valve in a case where leakage of the refrigerant flowing through the first refrigerant pipe is detected by the first refrigerant leakage sensor, and configured to change, after the compressor is stopped and the first flow control valve is fully closed, an opening speed of the first flow control valve to a speed less than an opening speed of the first flow control valve adopted before the leakage of the refrigerant is detected.

Advantageous Effects of Invention

According to an embodiment of the present disclosure, a rate at which refrigerant leaks from the first indoor unit is caused to reduce and, as a result, the concentration of leaked refrigerant in the indoor space is caused to reduce at a low level. Further, the amount of refrigerant retained in the outdoor unit is caused to reduce.

DESCRIPTION OF EMBODIMENT

Figure 1:
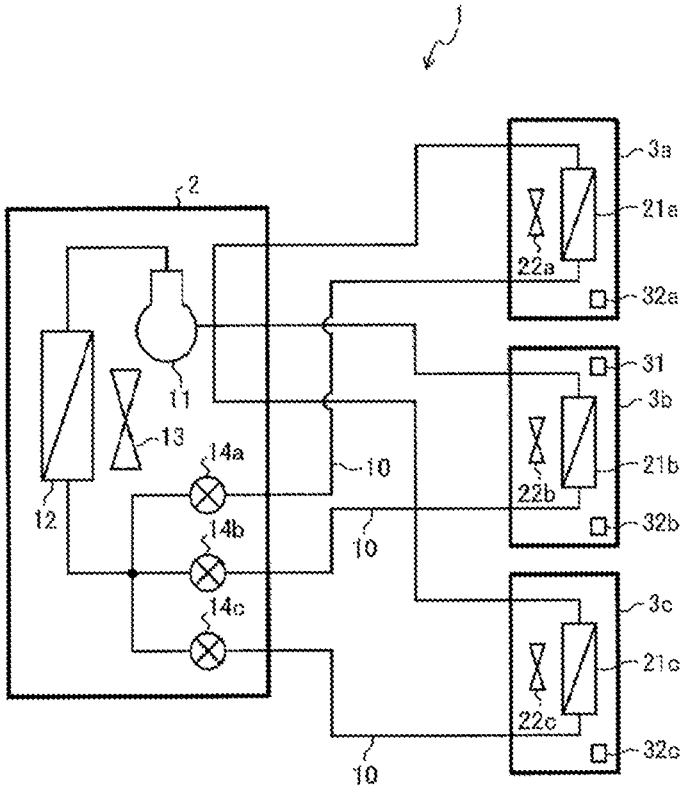
FIG. 1 is a diagram for describing a refrigerant system of a variable refrigerant flow system according to an embodiment.

Hereinafter, a variable refrigerant flow system according to an embodiment will be described with reference to drawings. In the drawings, identical elements are given the same reference signs, and repeated description will be made only when the repeated description is necessary.

Embodiment 1-1 Configuration

FIG. 1 is a diagram for describing a refrigerant system of a variable refrigerant flow system according to the embodiment.

As shown in FIG. 1, in a variable refrigerant flow system 1, an outdoor unit 2 and a plurality of indoor units 3*a* to 3*c* are connected via refrigerant pipes 10. The outdoor unit 2 and the plurality of indoor units 3*a* to 3*c* form a single refrigeration cycle.

In this refrigeration cycle, refrigerant compressed by a compressor 11 of the outdoor unit 2 is caused to cycle to an indoor heat exchanger 21*a* via an outdoor heat exchanger 12 and a flow control valve 14*a*, and is caused to return to the compressor 11 again. The refrigerant compressed by the compressor 11 is also caused to cycle to an indoor heat exchanger 21*b* via the outdoor heat exchanger 12 and a flow control valve 14*b*, and is caused to return to the compressor 11 again. Further, the refrigerant compressed by the compressor 11 is caused to cycle to an indoor heat exchanger 21*c* via the outdoor heat exchanger 12 and a flow control valve 14*c*, and is caused to return to the compressor 11 again. By making use of this refrigeration cycle, the variable refrigerant flow system 1 maintains an indoor unit space at a constant temperature by the state change of cycling refrigerant, that is, by transfer of heat when refrigerant is liquefied and gasified.

In the embodiment, a combustible refrigerant is used as refrigerant. A combustible refrigerant is a refrigerant that combusts when the concentration of refrigerant relative to air falls within a particular range and an ignition source is present Examples of the combustible refrigerant may be a single component refrigerant or a mixed refrigerant of HFO-1234yf (CF3CF═CH2), or a hydrocarbon refrigerant, such as propane (R290). A refrigerant referred to as a slightly flammable refrigerant is also included in the combustible refrigerant in the embodiment.

The outdoor unit 2 includes the compressor 11, the outdoor heat exchanger 12, an outdoor fan 13, and flow control valves 14*a* to 14*c*.

The compressor 11 is connected to the refrigerant pipes 10 extending from the respective indoor units 3*a* to 3*c*. The compressor 11 compresses refrigerant flowing through the refrigerant pipes 10, extending from the respective indoor units 3*a* to 3*c*, and discharges the refrigerant to the outdoor heat exchanger 12.

The outdoor heat exchanger 12 exchanges heat with the outside by using the compressed refrigerant, and discharges the refrigerant that is subjected to heat exchange to the refrigerant pipes 10 connected to the respective indoor units 3*a* to 3*c*.

The outdoor fan 13 blows heat generated at the time of exchanging heat by the outdoor heat exchanger 12.

The flow control valves 14*a* to 14*c* are also referred to as expansion valves. The flow control valves 14*a* to 14*c* are provided to the plurality of respective refrigerant pipes 10 connected to the respective indoor units 3*a* to 3*c*. The flow control valve 14*a* adjusts the flow rate of refrigerant flowing through the refrigerant pipe 10 connected to the indoor unit 3*a* by changing the opening degree of the valve. The flow control valve 14*b* adjusts the flow rate of refrigerant flowing through the refrigerant pipe 10 connected to the indoor unit 3*b* by changing the opening degree of the valve. The flow control valve 14*c* adjusts the flow rate of refrigerant flowing through the refrigerant pipe 10 connected to the indoor unit 3*c* by changing the opening degree of the valve. The flow control valves 14*a* to 14*c* reduce the pressure of refrigerant compressed by the compressor 11. In the variable refrigerant flow system of the embodiment, the opening degrees of the flow control valves 14*a* to 14*c* are individually controlled by a control unit of the outdoor unit 2 described later on the basis of the operation situations of the indoor units.

The flow control valves 14*a* to 14*c* are opened at a normal opening speed of the valves. In the embodiment, the normal opening speed of the valves is greater than the opening speed of the flow control valves 14*a* to 14*c* adopted after leakage of refrigerant is detected by a refrigerant leakage sensor 31 described later.

The indoor unit 3*a* includes the indoor heat exchanger 21*a*, an indoor fan 22*a*, and a warning unit 32*a*. The indoor unit 3*b* includes the indoor heat exchanger 21*b*, an indoor fan 22*b*, and a warning unit 32*b*. The indoor unit 3*c* includes the indoor heat exchanger 21*c*, an indoor fan 22*c*, and a warning unit 32*c*. The indoor unit 3*b* further includes the refrigerant leakage sensor 31.

The indoor heat exchanger 21*a* exchanges heat between refrigerant reduced in pressure by the flow control valve 14*a* and air in the indoor space around the indoor heat exchanger 21*a*. The indoor heat exchanger 21*b* exchanges heat between refrigerant reduced in pressure by the flow control valve 14*b* and air in the indoor space around the indoor heat exchanger 21*b*. The indoor heat exchanger 21*c* exchanges heat between refrigerant reduced in pressure by the flow control valve 14*c* and air in the indoor space around the indoor heat exchanger 21*c*. The refrigerant that is subjected to heat exchange is caused to return to the compressor 11 via the respective refrigerant pipes 10 of the indoor units 3*a* to 3*c*.

The indoor fan 22*a* blows air that is in the indoor space and from which heat is removed by the indoor heat exchanger 21*a*. The indoor fan 22*b* blows air that is in the indoor space and from which heat is removed by the indoor heat exchanger 21*b*. The indoor fan 22*c* blows air that is in the indoor space and from which heat is removed by the indoor heat exchanger 21*c*.

The warning units 32*a* to 32*c* are buzzers or lamps that issue a warning, for example. The warning unit 32*a* issues a warning in accordance with instructions from a control unit 30*a* of the indoor unit 3*a* described later. The warning unit 32*b* issues a warning in accordance with instructions from a control unit 30*b* of the indoor unit 3*b* described later. The warning unit 32*c* issues a warning in accordance with instructions from a control unit 30*c* of the indoor unit 3*c* described later.

The refrigerant leakage sensor 31 is provided in the indoor unit 3*b*. The refrigerant leakage sensor 31 may be provided on the outside of the indoor unit 3*b*. The refrigerant leakage sensor 31 detects leakage of refrigerant from a refrigerant circuit forming the refrigeration cycle. Specifically, the refrigerant leakage sensor 31 detects leakage of refrigerant flowing through the refrigerant pipe of the indoor unit 3*b*. The refrigerant leakage sensor 31 is an oxygen concentration sensor or a combustible gas detection sensor, for example. The refrigerant leakage sensor 31 also detects the concentration of leaked refrigerant.

Figure 2:
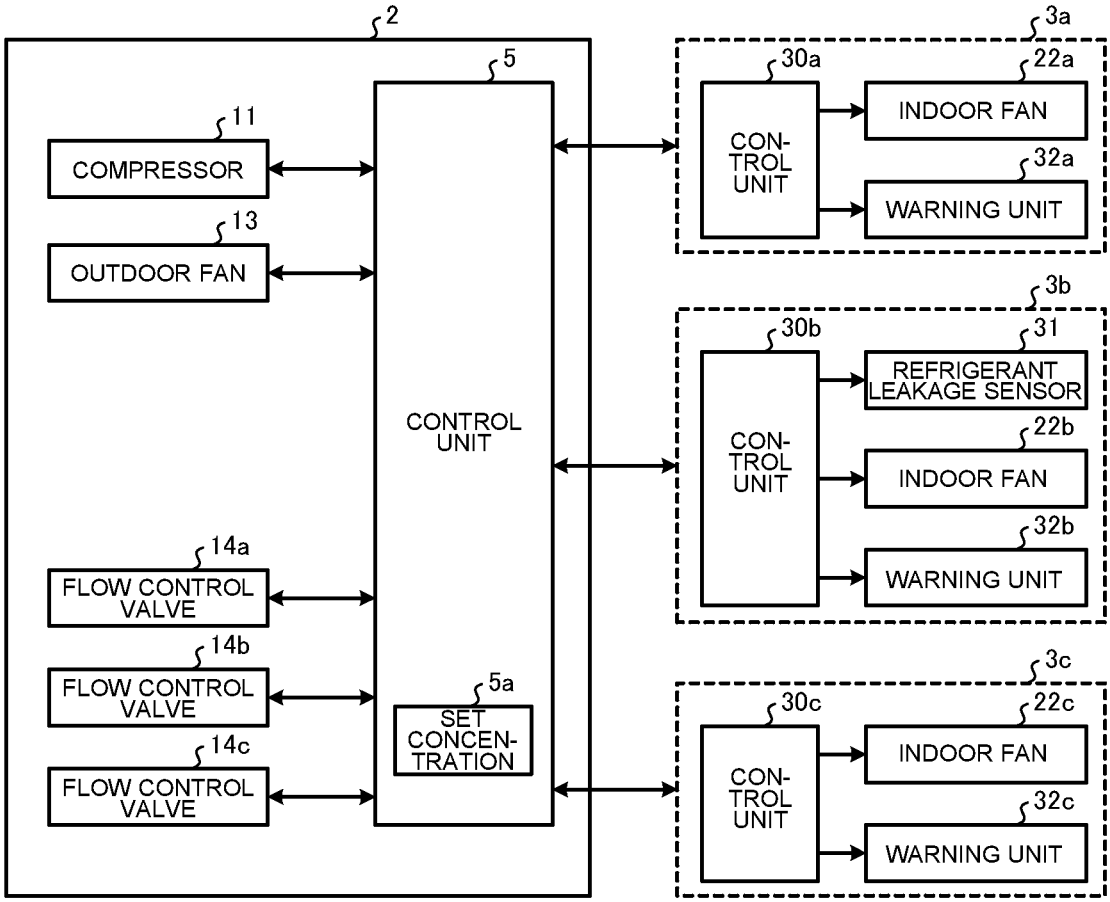
FIG. 2 is a block diagram for describing control of the variable refrigerant flow system according to the embodiment.

FIG. 2 is a block diagram for describing control of the variable refrigerant flow system according to the embodiment.

As shown in FIG. 2, the outdoor unit 2 includes a control unit 5, and the indoor units 3*a*, 3*b*, 3*c* respectively include the control units 30*a*, 30*b*, 30*c*.

The control unit 5 of the outdoor unit 2 controls the entire variable refrigerant flow system 1. Specifically, the control unit 5 controls the compressor 11, the outdoor fan 13, and the flow control valves 14*a* to 14*c* of the outdoor unit 2, and performs processing to achieve the action according to the embodiment.

The control unit 5 is communicably connected to the control units 30*a* to 30*c* of the indoor units 3*a* to 3*c*. For example, upon receipt of an operation signal transmitted from the control unit 30*a*, 30*b*, 30*c* of the indoor unit 3*a*, 3*b*, 3*c*, the control unit 5 controls the compressor 11, the outdoor fan 13, and the flow control valves 14*a* to 14*c* of the outdoor unit 2. Further, the control unit 5 stores a set concentration 5*a*, which is used in processing of detecting refrigerant leakage.

The control units 30*a*, 30*b*, 30*c* respectively exercise overall control of the indoor units 3*a*, 3*b*, 3*c*. Specifically, the control units 30*a*, 30*b*, 30*c* respectively control the indoor fans 22*a*, 22*b*, 22*c* and the warning units 32*a*, 32*b*, 32*c*, and perform processing to achieve the action according to the embodiment. The control units 30*a*, 30*b*, 30*c* each receive an operation instruction from a remote control or an operation button of the corresponding one of the indoor units 3*a*, 3*b*, 3*c*. The control units 30*a*, 30*b*, 30*c* each output an operation instruction signal to the control unit 5 together with an ID of the corresponding one of the indoor units 3*a*, 3*b*, 3*c*.

Further, when leakage of refrigerant is detected by the refrigerant leakage sensor 31, the control unit 30*b* of the indoor unit 3*b* outputs a refrigerant leakage detection signal to the control unit 5.

Each of the control unit 5 of the outdoor unit 2 and the control units 30*a* to 30*c* of the indoor units 3*a* to 3*c* includes a memory that stores programs and other data, and a central processing unit (CPU). Such a component may be achieved by the CPU executing the program, or may be achieved by a hardware circuit.

The indoor unit 3*b* corresponds to a first indoor unit. The refrigerant leakage sensor 31 corresponds to a first refrigerant leakage sensor. The flow control valve 14*b* corresponds to a first flow control valve. The refrigerant pipe 10 connected to the indoor unit 3*b* corresponds to a first refrigerant pipe. The warning unit 32*b* corresponds to a first warning unit. The indoor unit 3*a*, 3*c* corresponds to a second indoor unit. The flow control valve 14*a*, 14*c* corresponds to a second flow control valve. The refrigerant pipe 10 connected to the indoor unit 3*a*, 3*c* corresponds to a second refrigerant pipe. The warning unit 32*a*, 32*c* corresponds to a second warning unit.

1-2 Action

Next, the action of the refrigerant system of the variable refrigerant flow system according to the embodiment will be described.

Figure 3:
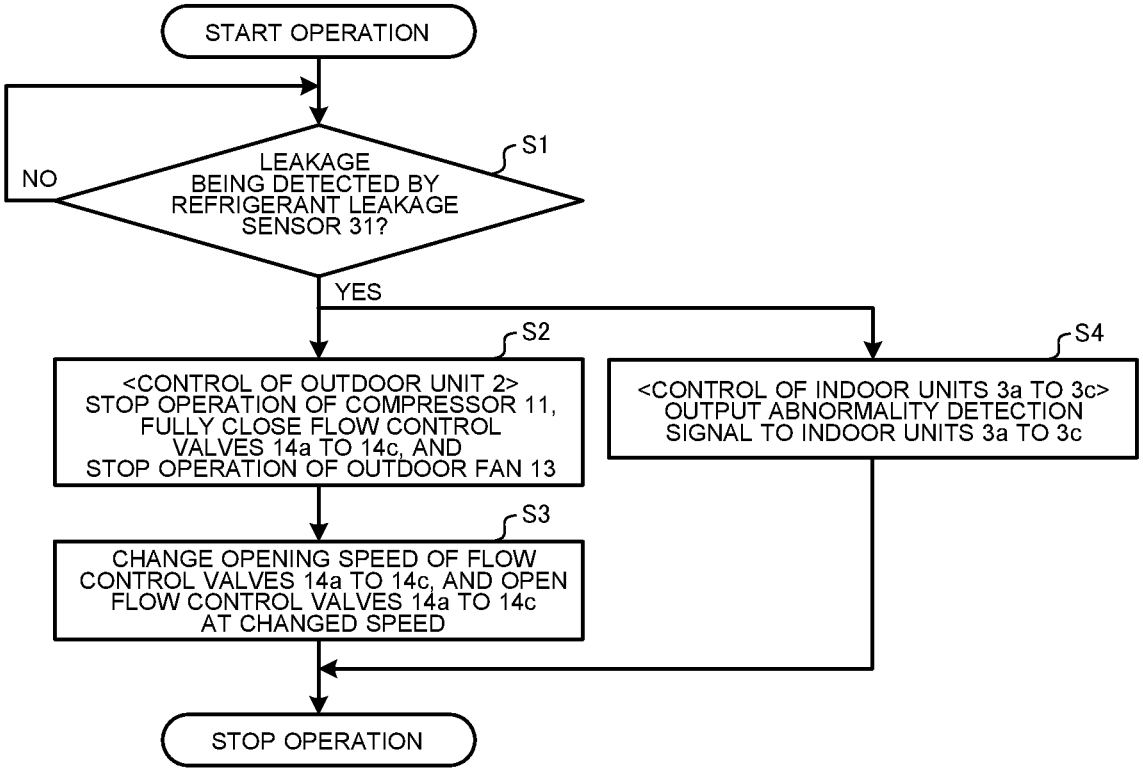
FIG. 3 is a flowchart for describing the action of the refrigerant system of the variable refrigerant flow system according to the embodiment.

FIG. 3 is a flowchart for describing the action of the refrigerant system of the variable refrigerant flow system according to the embodiment.

After the operation of the indoor units 3*a* to 3*c* is started, the control unit 5 determines whether leakage of refrigerant is detected by the refrigerant leakage sensor 31 (S1). Specifically, when the refrigerant leakage sensor 31 detects leakage of refrigerant, the control unit 30*b* of the indoor unit 3*b* transmits a refrigerant leakage detection signal to the control unit 5. When the control unit 5 receives the refrigerant leakage detection signal from the control unit 30*b*, the control unit 5 detects leakage of refrigerant.

When leakage of refrigerant is detected in step S1 (YES in S1), the control unit 5 controls the outdoor unit 2 and the indoor units 3*a* to 3*c*. When leakage of refrigerant is not detected in step S1, detection of leakage of refrigerant is continued (NO in S1).

Regarding control of the outdoor unit 2, the operation of the compressor 11 is stopped, the flow control valves 14*a* to 14*c* are fully closed, and the operation of the outdoor fan 13 is stopped (S2). Subsequently, the opening speed of the flow control valves 14*a* to 14*c* is changed to a speed less than the speed adopted before leakage of refrigerant is detected, and the flow control valves 14*a* to 14*c* are opened at the changed speed (S3). That is, in the embodiment, when leakage is detected, the flow control valves 14*a* to 14*c* are controlled such that the flow control valves 14*a* to 14*c* fully close and then the opening degrees of the flow control valves 14*a* to 14*c* gradually increase.

In contrast, regarding the indoor units 3*a* to 3*c*, when the control unit 5 receives a refrigerant leakage detection signal from the control unit 30*b* of the indoor unit 3*b*, the control unit 5 outputs an abnormality detection signal to each of the control units 30*a* to 30*c* of the indoor units 3*a* to 3*c* (S4).

Figure 4:
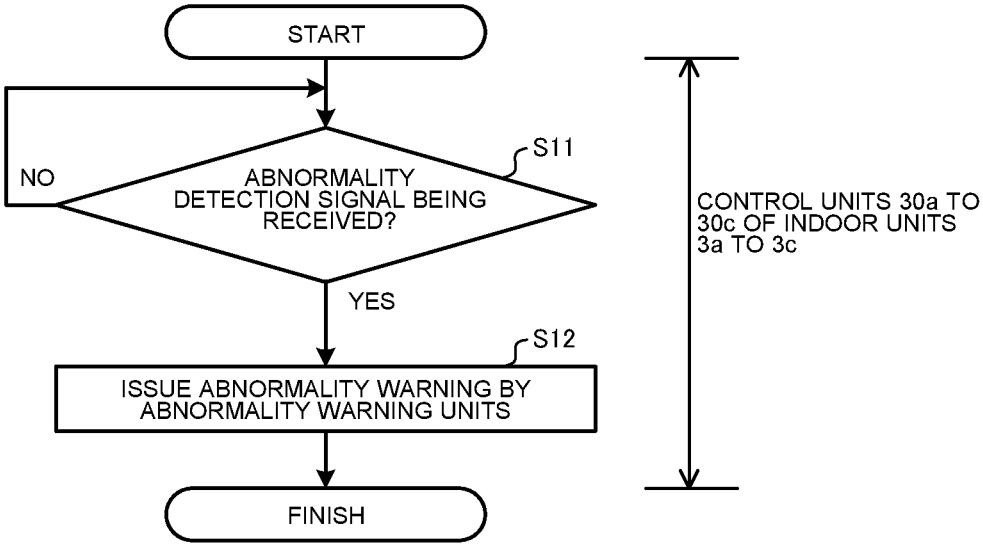
FIG. 4 is a flowchart for describing the actions of control units 30*a* to 30*c* of indoor units 3*a* to 3*c*.

FIG. 4 is a flowchart for describing the action of the control units 30*a* to 30*c* of the indoor units 3*a* to 3*c*.

When the control units 30*a* to 30*c* of the indoor units 3*a* to 3*c* receive the abnormality detection signal (YES in S11), the control units 30*a* to 30*c* control the warning units 32*a* to 32*c* such that a warning is output from each of the warning units 32*a* to 32*c* (S12).

In contrast, when the abnormality detection signal is not received in step S11 (NO in S11), monitoring for the receipt of an abnormality detection signal is continued.

Figure 5:
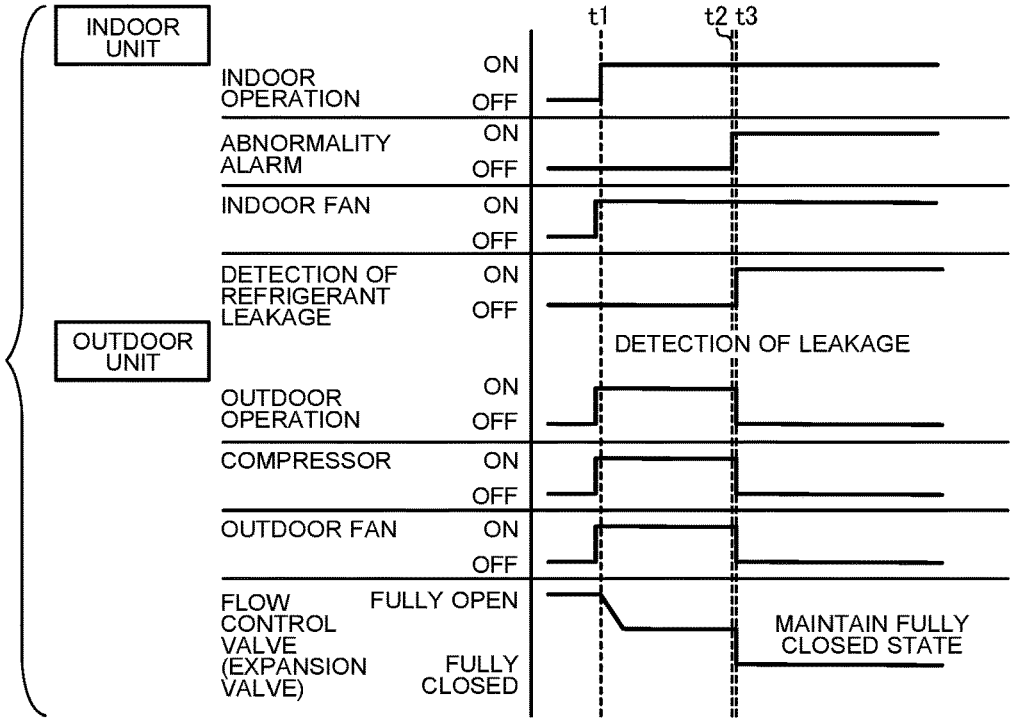
FIG. 5 Related Art
FIG. 5 is a state transition diagram showing the state of some variable refrigerant flow system when refrigerant leakage is detected.

FIG. 5 is a state transition diagram showing the state of some variable refrigerant flow system when refrigerant leakage is detected.

As shown in FIG. 5, in the case where the operation of an indoor unit is "ON" at time t1, and there is no abnormality, that is, in the case where abnormality alarm is "OFF", indoor fans of indoor units are "ON", and detection of refrigerant leakage is "OFF".

In such a state, the operation of an outdoor unit is "ON", a compressor is "ON", an outdoor fan is "ON", and flow control valves are "FULLY OPEN". The opening degree of the flow control valves fluctuates in accordance with the operation from the indoor unit.

When an abnormality occurs at time t2 and refrigerant leakage is detected at time t3, the operation of the outdoor unit is switched to "OFF", the compressor is switched to "OFF", the outdoor fan is switched to "OFF", and the flow control valves are "FULLY CLOSED". Even after the compressor is stopped, the flow control valves maintain a "FULLY CLOSED" state and hence, there is no possibility that refrigerant flows into the indoor unit.

Figure 6:
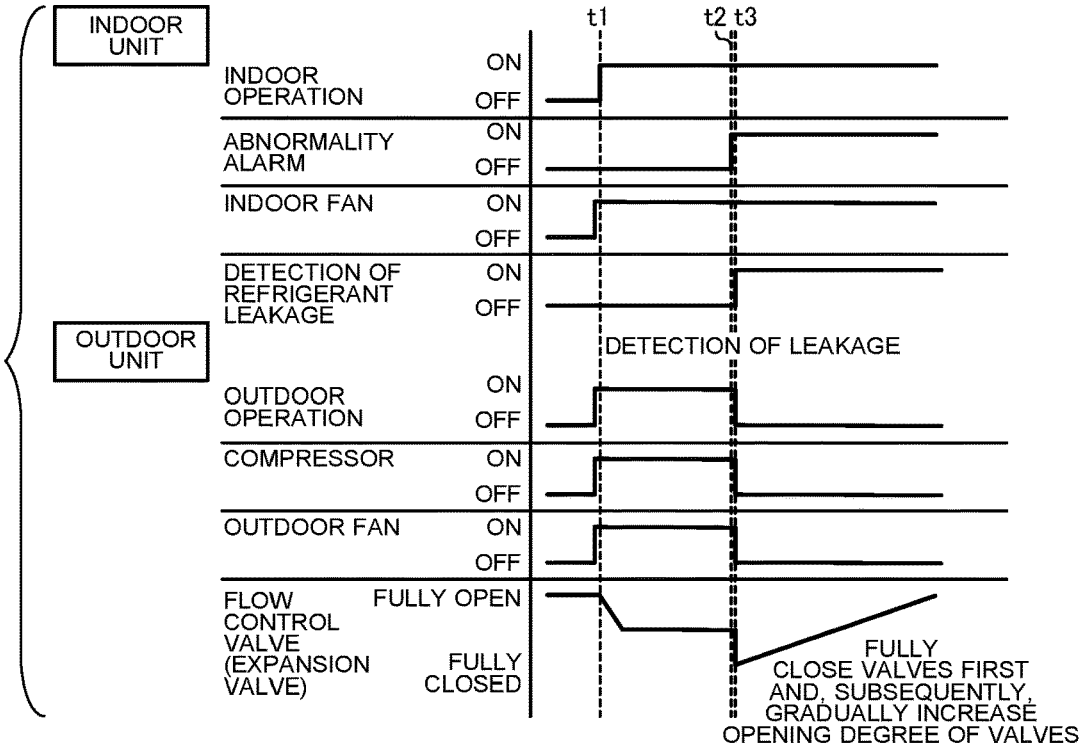
FIG. 6 is a state transition diagram showing the state of the variable refrigerant flow system according to the embodiment when refrigerant leakage is detected.

FIG. 6 is a state transition diagram showing the state of the variable refrigerant flow system according to the embodiment when refrigerant leakage is detected.

When an abnormality occurs at time t2 and refrigerant leakage is detected at time t3, the operation of the outdoor unit is switched to "OFF", the compressor is switched to "OFF", and the outdoor fan is switched to "OFF" in the same manner as FIG. 5. The point of difference in FIG. 6 from FIG. 5 is that the flow control valves are first "FULLY CLOSED" and, subsequently, the opening degree of the valves is gradually increased, that is, the opening speed of the flow control valves is set to a low speed.

1-3 Advantageous Effects

According to the embodiment, after refrigerant leakage is detected by the refrigerant leakage sensor 31, the operation of the compressor 11 is stopped, and the flow control valves 14*a* to 14*c* are "FULLY CLOSED". Subsequently, the opening speed of the flow control valves 14*a* to 14*c* is changed to a speed less than the speed adopted before leakage of refrigerant is detected. With such an operation, the rate of leakage from the indoor unit where leakage is occurring is caused to reduce. As a result, the concentration of leaked refrigerant in the indoor space is caused to reduce to a low level.

2 Modification 2-1 Modification 1

In the embodiment, when leakage of refrigerant is detected, the flow control valves 14*a* to 14*c* are "FULLY CLOSED" and, subsequently, the opening speed of the flow control valves 14*a* to 14*c* may be decided on the basis of the concentration of leaked refrigerant.

Figure 7:
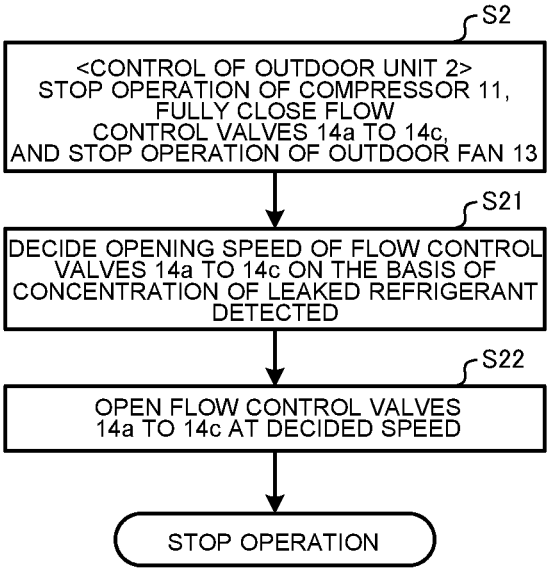
FIG. 7 is a flowchart for describing a modification 1 of the action of a control unit 5.

FIG. 7 is a flowchart for describing a modification 1 of the action of the control unit 5.

As shown in FIG. 7, the control unit 5 controls the outdoor unit 2 in step S2 shown in FIG. 3 and, subsequently, decides the opening speed of the flow control valves 14*a* to 14*c* on the basis of the concentration of leaked refrigerant detected by the refrigerant leakage sensor 31 (S21). For example, when the concentration of leaked refrigerant is high, the opening speed of the flow control valves 14*a* to 14*c* is set to a speed greater than that when the concentration of leaked refrigerant is low.

Next, the flow control valves 14*a* to 14*c* are opened at the decided speed (S22).

With such operations, the rate of leakage from the indoor unit where leakage is occurring is caused to be set to an appropriate rate. As a result, the concentration of leaked refrigerant in the indoor space is caused to reduce to a low level.

2-2 Modification 2

In the embodiment, when leakage of refrigerant is detected, the flow control valves 14*a* to 14*c* are "FULLY CLOSED" and, subsequently, the opening speed of the flow control valves 14*a* to 14*c* may be decided on the basis of the set concentration.

Figure 8:
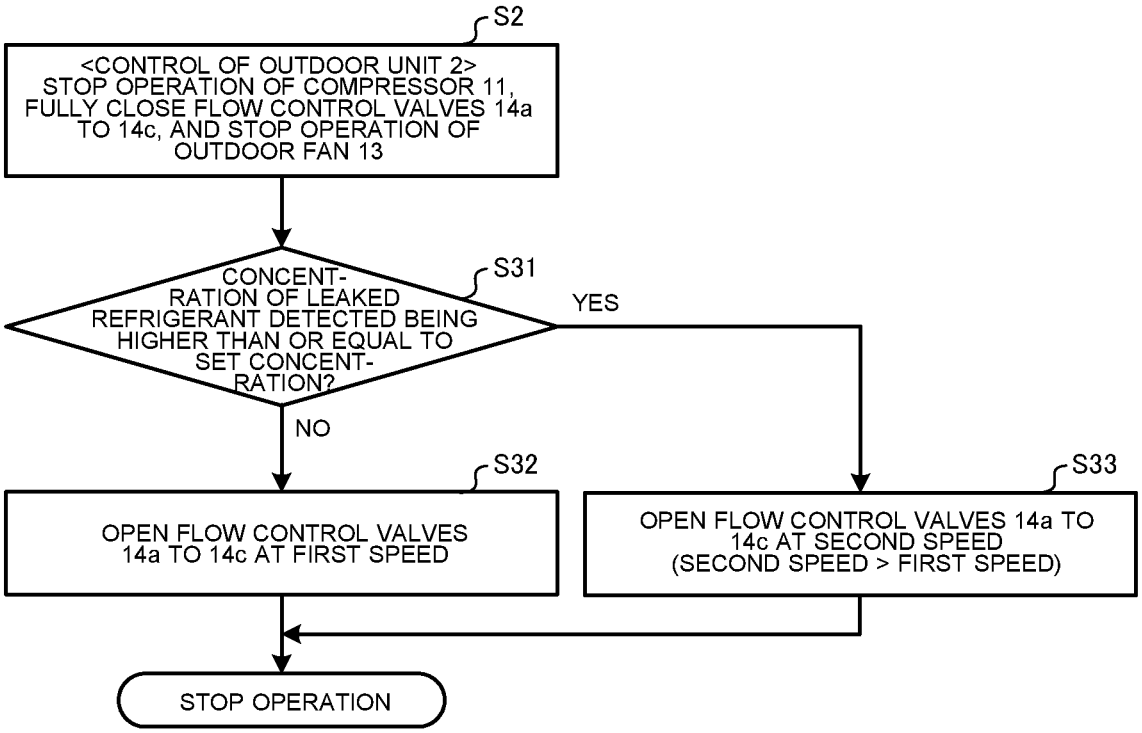
FIG. 8 is a flowchart for describing a modification 2 of the action of the control unit 5.

FIG. 8 is a flowchart for describing a modification 2 of the action of the control unit 5.

As shown in FIG. 8, the control unit 5 controls the outdoor unit 2 in step S2 shown in FIG. 3 and, subsequently, determines whether the concentration of leaked refrigerant detected by the refrigerant leakage sensor 31 is higher than or equal to the set concentration (S31).

When the concentration of leaked refrigerant is lower than the set concentration (NO in S31), the flow control valves 14*a* to 14*c* are opened at a first speed (S32). When the concentration of leaked refrigerant is higher than or equal to the set concentration (YES in S31), the flow control valves 14*a* to 14*c* are opened at a second speed (S33). The second speed is greater than the first speed.

With such operations, the rate of leakage from the indoor unit where leakage is occurring is caused to be set to an appropriate rate. As a result, the concentration of leaked refrigerant in the indoor space is caused to reduce to a low level.

2-3 Modification 3

In the embodiment, when leakage of refrigerant is detected, the flow control valves 14*a* to 14*c* are "FULLY CLOSED" and, subsequently, the opening speed of the flow control valves 14*a* to 14*c* may be controlled such that the concentration of leaked refrigerant is equal to a set concentration.

Figure 9:
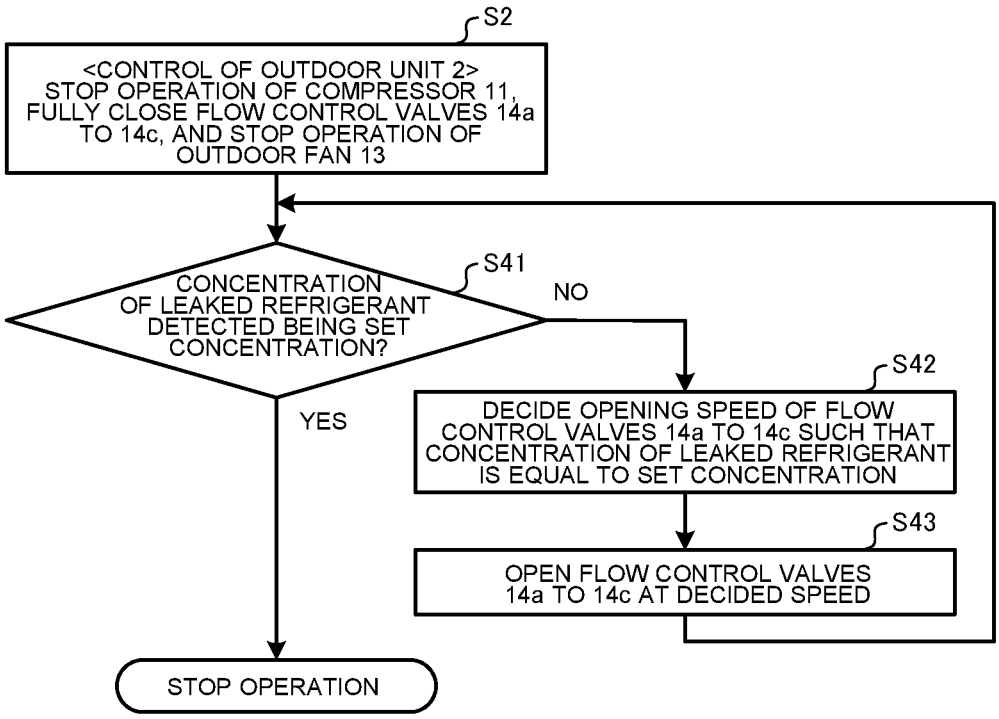
FIG. 9 is a flowchart for describing a modification 3 of the action of the control unit 5.

FIG. 9 is a flowchart for describing a modification 3 of the action of the control unit 5.

As shown in FIG. 9, the control unit 5 controls the outdoor unit 2 in step S2 shown in FIG. 3 and, subsequently, determines whether the concentration of leaked refrigerant detected by the refrigerant leakage sensor 31 is the set concentration (S41).

When it is determined in step S41 that the concentration of leaked refrigerant is the set concentration (YES in S41), the operation of the outdoor unit 2 is stopped. In contrast, when it is determined in step S41 that the concentration of leaked refrigerant is not the set concentration (NO in S41), the opening speed of the flow control valves 14*a* to 14*c* is decided such that the concentration of leaked refrigerant is equal to the set concentration (S42). Then, the flow control valves 14*a* to 14*c* are opened at the decided speed (S43), and the processing returns to step S41.

With such operations, it is possible to maintain a constant concentration of leaked refrigerant in the indoor space, and the concentration of leaked refrigerant in the indoor space is caused to reduce to a low level.

2-4 Modification 4

In the embodiment, when leakage of refrigerant is detected, an operation signal for operation or other performance transmitted from the indoor unit 3*a*, 3*b*, 3*c* may be overridden.

Figure 10:
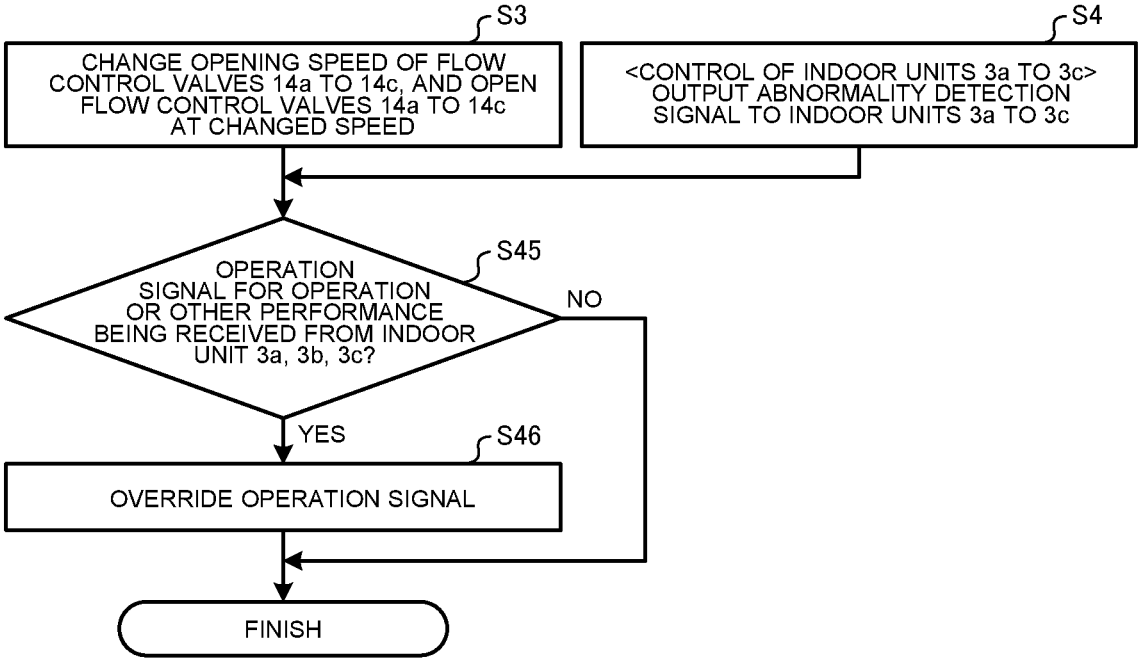
FIG. 10 is a flowchart for describing a modification 4 of the action of the control unit 5.

FIG. 10 is a flowchart for describing a modification 4 of the action of the control unit 5.

As shown in FIG. 10, after the processing in step S3 and step S4 shown in FIG. 3 is finished, the control unit 5 determines whether an operation signal for operation or other performance is received from the control unit 30*a*, 30*b*, 30*c* of the indoor unit 3*a*, 3*b*, 3*c* (S45).

When it is determined in step S45 that the operation signal for operation or other performance is received from the control unit 30*a*, 30*b*, 30*c* of the indoor unit 3*a*, 3*b*, 3*c* (YES in S45), the control unit 5 overrides the received operation signal (S46). That is, even when the control unit 5 receives the operation signal, the control unit 5 does not exercise control in accordance with the operation signal. In contrast, when the operation signal is not received (NO in S45), the control unit 5 stops the operation of the outdoor unit 2.

With such operations, it is possible to reduce the amount of refrigerant flowing into an indoor unit having leakage due to operation of the outdoor unit and hence, the concentration of leaked refrigerant in the indoor space is caused to reduce to a low level.

2-5 Modification 5

In the embodiment, a configuration may be adopted where, in addition to the indoor unit 3*b*, the refrigerant leakage sensor 31, used as a second refrigerant leakage sensor, is also provided to each of the indoor units 3*a*, 3*c* to specify an indoor unit where refrigerant leakage occurs, the opening speed of the flow control valve of the refrigerant pipe 10 of the specified indoor unit is changed, and the operation of the other indoor units is continued.

Figure 11:
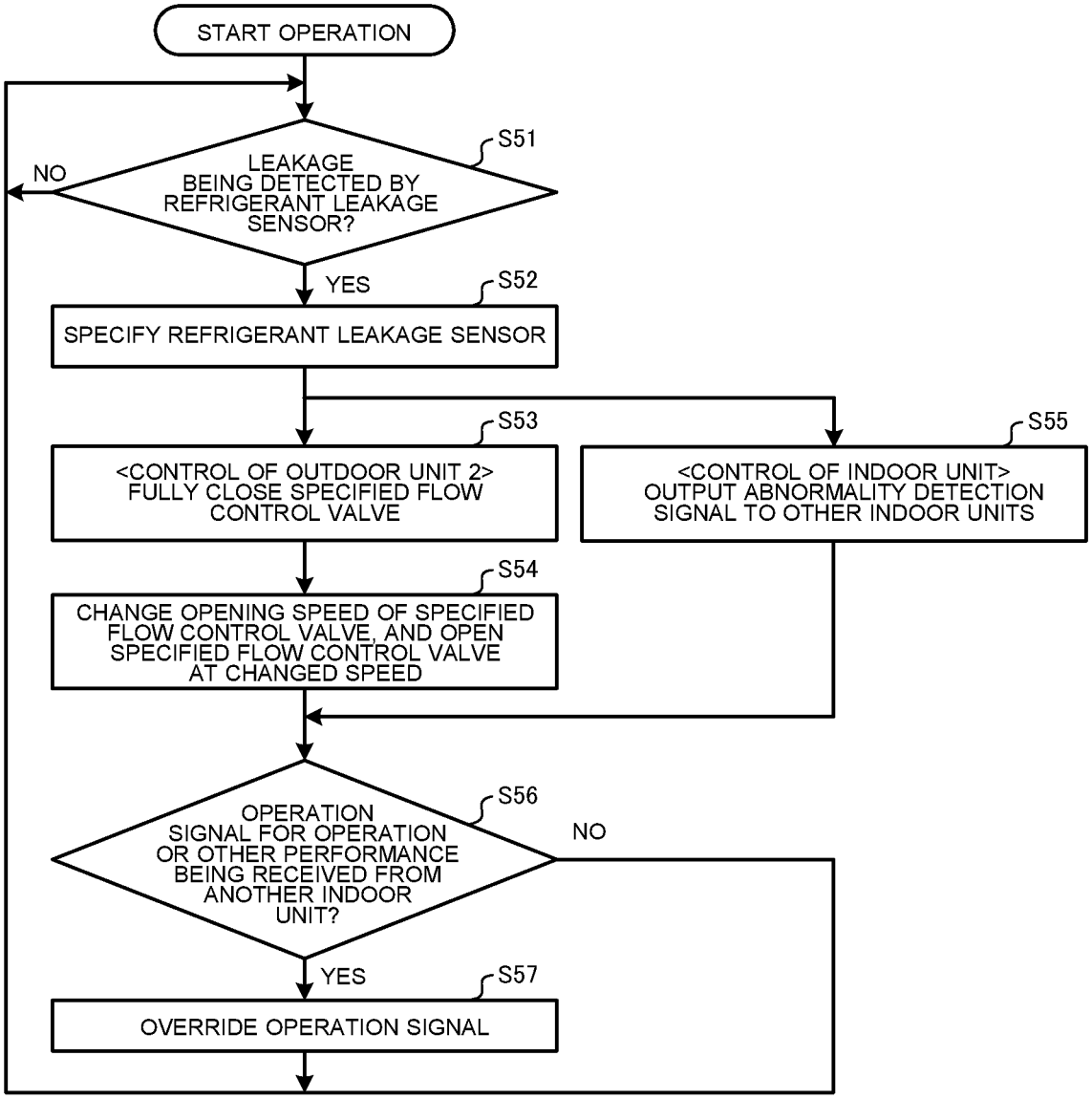
FIG. 11 is a flowchart for describing a modification 5 of the action of the control unit 5.

FIG. 11 is a flowchart for describing a modification 5 of the action of the control unit 5.

After the operation of the indoor units 3*a* to 3*c* is started, the control unit 5 determines whether leakage of refrigerant is detected by one of the refrigerant leakage sensors 31 provided to the indoor units 3*a* to 3*c* (S51).

When it is determined in step S51 that leakage of refrigerant is detected by one of the refrigerant leakage sensors 31 provided to the indoor units 3*a* to 3*c* (YES in S51), the control unit 5 specifies the refrigerant leakage sensor 31 that has detected leakage of refrigerant (S52). For example, the control unit 5 specifies which indoor unit includes the refrigerant leakage sensor by the ID applied to a refrigerant leakage detection signal.

In contrast, when it is determined that leakage of refrigerant is not detected by any of the refrigerant leakage sensors 31 provided to the indoor units 3*a* to 3*c* (NO in S51), monitoring for leakage of refrigerant is continued.

Next, the control unit 5 controls the outdoor unit 2 and the indoor units 3*a* to 3*c*.

Regarding control of the outdoor unit 2, the flow control valve of the indoor unit including the specified refrigerant leakage sensor is fully closed (S53).

Subsequently, the opening speed of the flow control valve corresponding to the specified refrigerant leakage sensor is changed to a speed less than the speed adopted before leakage of refrigerant is detected, and the flow control valve corresponding to the specified refrigerant leakage sensor is opened at the changed speed (S54). That is, in the embodiment, when leakage is detected, the flow control valve of the indoor unit including the specified refrigerant leakage sensor is fully closed, and the opening degree of the flow control valve is controlled such that the opening degree of the flow control valve gradually increases.

In contrast, when the control unit 5 receives a refrigerant leakage detection signal, the control unit 5 outputs an abnormality detection signal to the control units of the other indoor units except for the specified indoor unit (S55).

Next, it is determined whether an operation signal for operation or other performance is received from another indoor unit (S56). When it is determined that the operation signal is received (YES in S56), the received operation signal is overridden (S57). That is, even when the control unit 5 receives an operation signal, the control unit 5 does not exercise control in accordance with the operation signal. In contrast, when the operation signal is not received (NO in S56), the processing returns to step S51.

With such operations, even if refrigerant leakage occurs in a specific indoor unit, the other indoor units are configured to continue the operation.

In the embodiment, the variable refrigerant flow system has been described. However, the embodiment is also applicable to an air-conditioning apparatus including one indoor unit and one outdoor unit.

An embodiment is presented for the sake of example, and is not intended to limit the scope of the embodiment. Various modifications of the embodiment are conceivable, and various omissions, substitutions, and changes may be made without departing from the gist of the embodiment. These embodiments and modifications of the embodiments are also included in the scope and gist of the embodiment.

REFERENCE SIGNS LIST

1: variable refrigerant flow system, 2: outdoor unit, 3*a*, 3*b*, 3*c*: indoor unit, 5: control unit, 5*a*: set concentration, 10: refrigerant pipe, 11: compressor, 12: outdoor heat exchanger, 13: outdoor fan, 14*a*, 14*b*, 14*c*: flow control valve, 21*a*, 21*b*, 21*c*: indoor heat exchanger, 22*a*, 22*b*, 22*c*: indoor fan, 30*a*, 30*b*, 30*c*: control unit, 31: refrigerant leakage sensor, 32*a*, 32*b*, 32*c*: warning unit

The invention claimed is:

1. An air-conditioning apparatus comprising:

a first indoor unit included in a single refrigeration cycle; and an outdoor unit connected to the first indoor unit via a first refrigerant pipe, the outdoor unit being included in the single refrigeration cycle, the first indoor unit being provided with a first refrigerant leakage sensor configured to detect leakage of refrigerant flowing through the first refrigerant pipe and a concentration of leaked refrigerant, the outdoor unit including a compressor configured to compress the refrigerant flowing through the first refrigerant pipe, a first flow control valve configured to adjust a flow rate of the refrigerant flowing through the first refrigerant pipe, and a control unit configured to stop the compressor and fully close the first flow control valve in a case where leakage of the refrigerant flowing through the first refrigerant pipe is detected by the first refrigerant leakage sensor, and configured to change, after the compressor is stopped and the first flow control valve is fully closed, an opening speed of the first flow control valve to a speed less than an opening speed of the first flow control valve adopted before the leakage of the refrigerant is detected.

2. The air-conditioning apparatus of claim 1, wherein the control unit is configured to change the opening speed of the first flow control valve based on the concentration of the leaked refrigerant detected by the first refrigerant leakage sensor.

3. The air-conditioning apparatus of claim 1, wherein the opening speed of the first flow control valve is set to a first speed in a case where the concentration of the leaked refrigerant detected by the first refrigerant leakage sensor is lower than a set concentration, and the opening speed of the first flow control valve is set to a second speed greater than the first speed in a case where the concentration of the leaked refrigerant detected by the first refrigerant leakage sensor is higher than or equal to the set concentration.

4. The air-conditioning apparatus of claim 1, wherein the control unit is configured to change the opening speed of the first flow control valve such that the concentration of the leaked refrigerant detected by the first refrigerant leakage sensor is equal to a set concentration.

5. The air-conditioning apparatus of claim 1, further comprising a second indoor unit included in the single refrigeration cycle, wherein the outdoor unit is connected to the second indoor unit via a second refrigerant pipe, the compressor is configured to compress refrigerant flowing through the second refrigerant pipe, the outdoor unit further includes a second flow control valve configured to adjust a flow rate of the refrigerant flowing through the second refrigerant pipe, and the control unit is configured to fully close the second flow control valve in a case where leakage of the refrigerant flowing through the first refrigerant pipe is detected by the first refrigerant leakage sensor and, after the second flow control valve is fully closed, the control unit is configured to change an opening speed of the second flow control valve from an opening speed of the second flow control valve adopted before the leakage of the refrigerant is detected.

6. The air-conditioning apparatus of claim 5, wherein the first indoor unit includes a first warning unit, the second indoor unit includes a second warning unit, and in a case where leakage of the refrigerant flowing through the first refrigerant pipe is detected by the first refrigerant leakage sensor, the control unit is configured to output an abnormality detection signal to cause the first warning unit and the second warning unit to issue a warning.

7. The air-conditioning apparatus of claim 5, wherein, in a case where leakage of the refrigerant flowing through the first refrigerant pipe is detected by the first refrigerant leakage sensor, the control unit is configured not to accept operation from the first indoor unit or the second indoor unit.

8. An air-conditioning apparatus comprising:

a first indoor unit included in a single refrigeration cycle;

a second indoor unit included in the single refrigeration cycle; and an outdoor unit connected to the first indoor unit via a first refrigerant pipe, and connected to the second indoor unit via a second refrigerant pipe, the outdoor unit being included in the single refrigeration cycle, the first indoor unit being provided with a first refrigerant leakage sensor configured to detect leakage of refrigerant flowing through the first refrigerant pipe and a concentration of leaked refrigerant, the second indoor unit being provided with a second refrigerant leakage sensor configured to detect leakage of refrigerant flowing through the second refrigerant pipe and a concentration of leaked refrigerant, the outdoor unit including a compressor configured to compress the refrigerant flowing through the first refrigerant pipe and the refrigerant flowing through the second refrigerant pipe, a first flow control valve configured to adjust a flow rate of the refrigerant flowing through the first refrigerant pipe, a second flow control valve configured to adjust a flow rate of the refrigerant flowing through the second refrigerant pipe, and a control unit configured to fully close the first flow control valve in a case where leakage of the refrigerant flowing through the first refrigerant pipe is detected by the first refrigerant leakage sensor, configured to change, after the first flow control valve is fully closed, an opening speed of the first flow control valve to a speed less than an opening speed of the first flow control valve adopted before the leakage of the refrigerant is detected, configured to fully close the second flow control valve in a case where leakage of the refrigerant flowing through the second refrigerant pipe is detected by the second refrigerant leakage sensor, and configured to change, after the second flow control valve is fully closed, an opening speed of the second flow control valve to a speed less than an opening speed of the second flow control valve adopted before the leakage of the refrigerant is detected.

* * * * *